US009042795B2

(12) United States Patent
Hayashi

(10) Patent No.: US 9,042,795 B2
(45) Date of Patent: May 26, 2015

(54) IMAGE FORMING APPARATUS

(71) Applicant: KYOCERA Document Solutions Inc., Osaka-shi, Osaka (JP)

(72) Inventor: Eriko Hayashi, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/010,822

(22) Filed: Aug. 27, 2013

(65) Prior Publication Data

US 2014/0064761 A1 Mar. 6, 2014

(30) Foreign Application Priority Data

Aug. 31, 2012 (JP) ..... 2012-190900

(51) Int. Cl.
*G03G 15/16* (2006.01)
*G03G 15/00* (2006.01)

(52) U.S. Cl.
CPC ..... *G03G 15/163* (2013.01); *G03G 15/6535* (2013.01); *G03G 15/1675* (2013.01); *G03G 15/657* (2013.01)

(58) Field of Classification Search
CPC ..... G03G 15/6535; G03G 2215/00573
USPC ..... 399/315
See application file for complete search history.

(56) References Cited

U.S. PATENT DOCUMENTS 3,966,199 A * 6/1976 Silverberg ..... 271/275
5,541,718 A * 7/1996 Oono ..... 399/297
5,621,504 A * 4/1997 Wakamatsu et al. ..... 399/1
5,926,683 A * 7/1999 Yuminamochi et al. ..... 399/398
6,205,300 B1 * 3/2001 Sakai ..... 399/66
6,731,890 B1 * 5/2004 Rakov et al. ..... 399/66
2009/0245858 A1 * 10/2009 Mizutani et al. ..... 399/111

FOREIGN PATENT DOCUMENTS

JP 09-080936 3/1997
JP 2001-083812 3/2001
JP 2010-256528 11/2010

OTHER PUBLICATIONS

Office Action Issued in Japanese Patent Application No. 2012-190900—Aug. 26, 2014.

* cited by examiner

*Primary Examiner* — Clayton E Laballe
*Assistant Examiner* — Leon W Rhodes, Jr.
(74) *Attorney, Agent, or Firm* — Gerald E. Hespos; Michael J. Porco; Matthew T. Hespos

(57) ABSTRACT

A transfer bias voltage supplier supplies, to a transfer member, a transfer bias voltage of a polarity opposite to the polarity of toner. The absolute value of transfer bias voltage to be supplied to the transfer member when a leading/trailing end of the sheet is passed through the nip portion is set smaller than when a toner image transfer region of the sheet is passed through the nip portion. A separation bias voltage supplier supplies, to a discharging electrode member, a separation bias voltage of a polarity opposite to the polarity of transfer bias voltage. The absolute value of separation bias voltage to be supplied to the discharging electrode member when the leading/trailing end of the sheet is passed through a discharging gap is set smaller than when the transfer region is passed through the discharging gap.

9 Claims, 5 Drawing Sheets

IMAGE FORMING APPARATUS

This application is based on Japanese Patent Application No. 2012-190900 filed on Aug. 31, 2012, the contents of which are hereby incorporated by reference.

BACKGROUND

The present disclosure relates to a technology for transferring, onto a sheet, a toner image carried on an image carrier (for instance, on a drum surface of a photosensitive drum), with use of a transfer member (for instance, a transfer roller) to which a transfer bias voltage is applied.

Image formation by an electrophotographic system includes a charging step, an exposure step, a developing step, a transferring step, and a fixing step.

In the transferring step, a transfer bias voltage is applied to a transfer roller (example of a transfer member). The transfer bias voltage is a bias voltage for use in transferring toner for forming a toner image onto a sheet. By performing the above operation, a toner image carried on the drum surface is transferred onto a sheet when the sheet is passed through a nip portion formed between the drum surface and the transfer roller.

The electric potential on the drum surface of the photosensitive drum may fluctuate by application of transfer bias voltage. Regarding the above drawback, there is described the following case, in which the polarity of electric charge for charging the drum surface in a charging step is positive, and the polarity of transfer bias voltage is negative. In this case, upon application of transfer bias voltage of negative polarity to the drum surface by a transfer roller, a region charged with negative electric charge may be formed on the drum surface. In the case where the drum surface has such a physical property that the drum surface is sensitive only to positive polarity in removing static electricity from the drum surface, it is impossible to remove the negative electric charge from the drum surface. As a result, the electric potential on the drum surface may fluctuate. The electric potential fluctuation on the drum surface may cause density variation in an image transferred onto a sheet.

The electric potential fluctuation on the drum surface may also occur because of the following reason. Since a transfer bias voltage is applied to the transfer roller, electric current flows via the nip portion between the drum surface and the transfer roller. If there is a sheet in the nip portion, the electrical resistance of the nip portion is large, as compared with a case, in which there is no sheet in the nip portion. As a result, the electrical resistance of the nip portion is sharply changed when the leading end or the trailing end of a sheet is passed through the nip portion. This causes an excessive current flow between the drum surface and the transfer roller. Consequently, the electric potential on the drum surface varies, and electric potential fluctuation may occur on the drum surface in the form of streaks, for instance. The electric potential fluctuation in the form of streaks appears as streak-like noise on an image transferred onto the sheet.

There has been proposed a technique for eliminating such electric potential fluctuation on the drum surface in the form of streaks. In the above technique, there is provided current detecting means for detecting electric current flowing from a transfer roller to a drum surface in applying a transfer bias voltage to the transfer roller. In the case where the electric current detected by the current detecting means has exceeded a predetermined threshold value when the trailing end of a preceding sheet is passed through the nip portion, the number of times of charging the region on the drum surface where the electric potential has fluctuated in the charging step is increased by delaying the timing of feeding a next sheet. In this way, the electric potential fluctuation is eliminated.

An object of the present disclosure is to provide an image forming apparatus that enables to prevent electric potential fluctuation on an image carrier.

SUMMARY

An image forming apparatus according to an aspect of the present disclosure includes an image carrier, a charging portion, an exposing portion, a developing portion, a transfer member, a discharging electrode member, a sheet conveying unit, a transfer bias voltage supplier, and a separation bias voltage supplier. The charging portion is configured to charge the image carrier. The exposing portion is configured to form an electrostatic latent image on the image carrier charged by the charging portion. The developing portion is configured to supply toner to the electrostatic latent image for forming a toner image on the image carrier. The transfer member is configured to form a nip portion by cooperation with the image carrier, the nip portion being configured to nip a sheet on which the toner image is to be transferred. The discharging electrode member is disposed to face the image carrier on a downstream side of the nip portion in a conveying direction of the sheet. The sheet conveying unit is configured to convey the sheet in such a manner that the sheet is passed through the nip portion and through a discharging gap, the discharging gap being formed by the discharging electrode member and the image carrier. The transfer bias voltage supplier is configured to supply, to the transfer member, a transfer bias voltage of a polarity opposite to a polarity of the toner for use in forming the toner image for transferring the toner image carried on the image carrier onto the sheet in the nip portion. The separation bias voltage supplier is configured to supply, to the discharging electrode member, a separation bias voltage of a polarity opposite to the polarity of the transfer bias voltage for separating the sheet carrying the transferred toner image thereon from the image carrier. The transfer bias voltage supplier is so configured that an absolute value of the transfer bias voltage to be supplied to the transfer member when at least one of a leading end and a trailing end of the sheet is passed through the nip portion is set smaller than an absolute value of the transfer bias voltage to be supplied to the transfer member when a transfer region of the toner image on the sheet is passed through the nip portion. The separation bias voltage supplier is so configured that an absolute value of the separation bias voltage to be supplied to the discharging electrode member when the at least one of the leading end and the trailing end of the sheet is passed through the discharging gap is set smaller than an absolute value of the separation bias voltage to be supplied to the discharging electrode member when the transfer region is passed through the discharging gap. The at least one of the leading end and the trailing end of the sheet is such that the absolute value of the transfer bias voltage to be supplied thereto is set smaller when the at least one of the leading end and the trailing end is passed through the nip portion.

These and other objects, features and advantages of the present disclosure will become more apparent upon reading the following detailed description along with the accompanying drawings.

DETAILED DESCRIPTION

Figure 1:
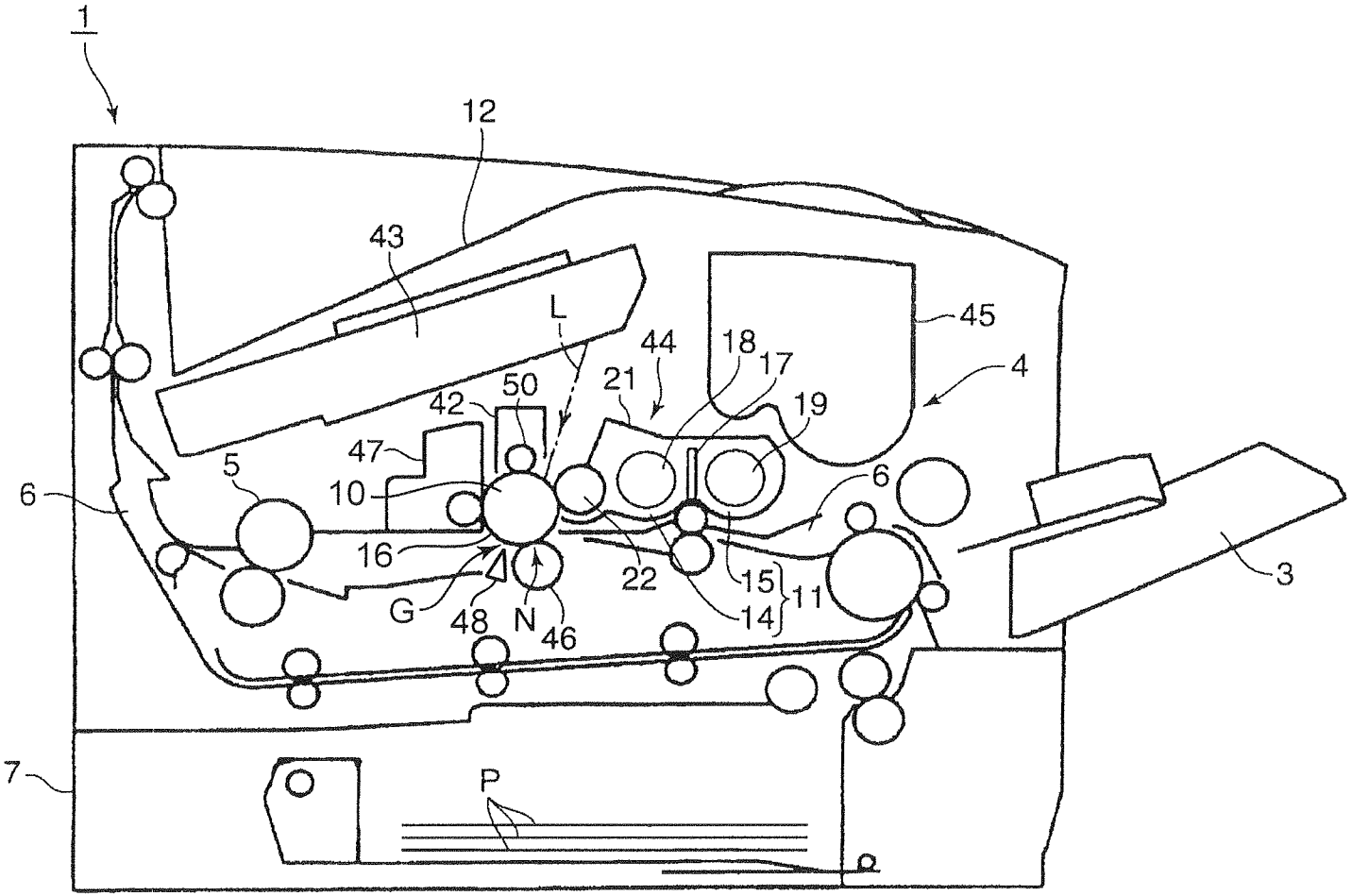
FIG. 1 is a diagram schematically showing an internal structure of an image forming apparatus embodying the present disclosure.

In the following, an embodiment of the present disclosure is described in detail referring to the drawings. In the following description, there is described a monochromatic printer as an example of the image forming apparatus. The present disclosure, however, is not limited to the above, but may be applied to other image forming apparatus such as a copying machine, a facsimile machine, and a complex machine having the functions of these machines.

FIG. 1 is a diagram schematically showing an internal structure of an image forming apparatus 1 embodying the present disclosure. The image forming apparatus 1 includes an image forming assembly 4 configured to form a toner image on a sheet P based on image data from an external device (for instance, from a personal computer), a fixing portion 5 configured to fix the toner image on the sheet P by applying heat to the toner image formed on the sheet P, a supply cassette 7 for accommodating a stack of sheets P, a discharge tray 12 on which the sheet P is discharged, a conveying path 6 along which the sheet P is conveyed from the supply cassette 7 toward the discharge tray 12 via the image forming assembly 4 and the fixing portion 5, a manual tray 3 disposed on the right surface of the image forming apparatus 1 shown in FIG. 1, and an operation portion (not shown) on which menu setting keys for causing an operator to designate various operations/instructions regarding image formation.

The image forming assembly 4 includes a photosensitive drum 10, a charger 42, an exposure device 43, a developing device 44, a toner cartridge 45, a transfer roller 46, a toner remover 47, and a separating member 48. The charger 42, the developing device 44, the transfer roller 46, the separating member 48, and the toner remover 47 are disposed in this order in the rotating direction of the photosensitive drum 10 (in the clockwise direction in FIG. 1) along the circumferential direction of the photosensitive drum 10. The exposure device 43 is disposed above the charger 42.

The photosensitive drum 10 is for instance an OPC (Organic Photo Conductor) drum or a photosensitive drum. A drum surface 16 (photosensitive layer) as the circumferential surface of the photosensitive drum 10 is constituted of a single-layer organic photosensitive member. The single-layer organic photosensitive member is configured such that an electric charge generation layer and an electric charge carrier layer are not separated from each other. There is proposed an organic photoconductor drum provided with plural photosensitive layers, in addition to the configuration provided with only one photosensitive layer. In the organic photosensitive drum provided with plural photosensitive layers, the electric charge generation layer and the electric charge carrier layer are separated from each other. On the other hand, in the single-layer photosensitive member, the electric charge generation layer and the electric charge carrier layer are not separated from each other. Accordingly, in the single-layer photosensitive member, even if the surface of the photosensitive layer is worn, stable photosensitive characteristics can be maintained, and the long-life photosensitive drum 10 can be obtained. The drum surface 16 is an example of an image carrier.

Figure 2:
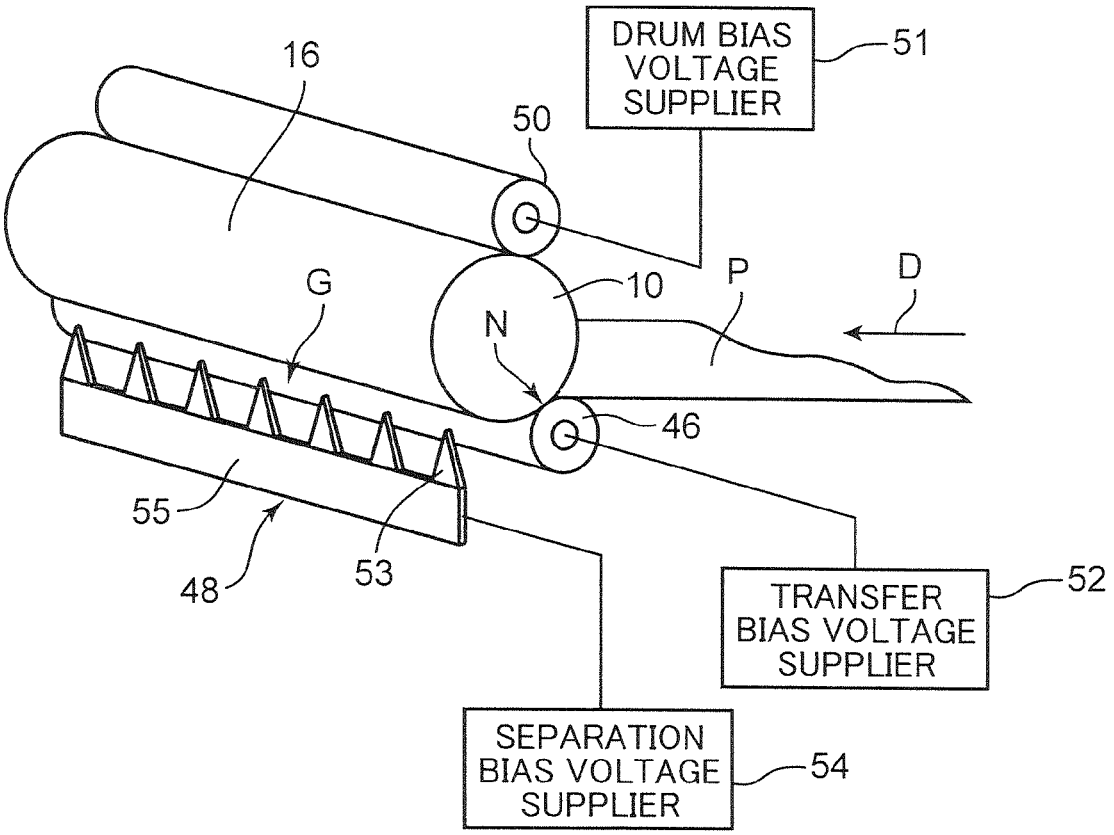
FIG. 2 is a perspective view showing a positional relationship between a photosensitive drum, a charging roller, a transfer roller, and a separating member.

The charger 42 has a charging roller 50. The charging roller 50 is described referring to FIG. 2. FIG. 2 is a perspective view showing a positional relationship between the photosensitive drum 10, the charging roller 50, the transfer roller 46, and the separating member 48. The circumferential surface of the charging roller 50 is substantially point-contacted with the drum surface 16 as a photosensitive layer. A drum bias voltage is supplied from a drum bias voltage supplier 51 to the charging roller 50. In this embodiment, the drum bias voltage is a direct-current voltage. Alternatively, the drum bias voltage may be an alternate-current voltage. Applying a drum bias voltage to the drum surface 16 via the charging roller 50 uniformly charges the drum surface 16. In other words, the electric potential on the drum surface 16 is made substantially uniform.

The development system employed in this embodiment is a reversal development system. An electrostatic latent image is formed on the drum surface 16 by preferentially removing electric charge by selective irradiation of laser light onto the drum surface 16, which is charged with positive or negative electric charge by the charger 42. In the reversal development system, a toner image is formed by supplying toner of the same polarity as the polarity of electric charge on the drum surface 16, onto the region on the drum surface 16 devoid of electric charge. In the development system employed in this embodiment, toner charged with positive electric charge is used. Accordingly, the polarity of drum bias voltage to be applied is positive.

The charger 42 (example of a charging portion) shown in FIG. 1 is constituted of the charging roller 50 and the drum bias voltage supplier 51. The charging portion includes the charging roller 50 to be contacted with the drum surface 16 of the photosensitive drum 10, and is configured to charge the drum surface 16 with use of the charging roller 50. In this way, the charging portion charges the drum surface 16 by a contact charging system.

As compared with a corona charging system, the contact charging system has various merits such that the voltage to be applied to the drum surface 16 can be made small for obtaining an intended electric potential on the drum surface 16, and the amount of ozone which may generate in the course of charging the drum surface 16 can be reduced to a trace amount.

Referring to FIG. 1, the exposure device 43 has a polygon mirror (not shown) configured to guide laser light L based on image data input from an external device such as a PC (personal computer) to the drum surface 16 of the photosensitive drum 10. The polygon mirror is configured to form an electrostatic latent image on the drum surface 16 by scanning laser light L on the drum surface 16 of the photosensitive drum 10 while being rotated by a certain drive source. The exposure device 43 is an example of an exposing portion.

The developing device 44 is an example of a developing portion, and is configured to form a toner image on the drum surface 16 by supplying toner onto an electrostatic latent image. In this embodiment, the developing device 44 uses a one-component developer excluding carrier and including only toner containing a magnetic material. As shown in FIG. 1, the developing device 44 includes, as basic constituent elements, a developing container 21 that defines the inner space of the developing device 44, a developer storing portion 11 formed in a bottom wall of the developing container 21, and a developing roller 22 disposed in an opening of the developing container 21.

The developer storing portion 11 is constituted of two developer storage chambers 14 and 15 extending in the longitudinal direction of the developing device 44 (in a direction perpendicular to the sheet plane of FIG. 1) and adjacent to each other. The developer storage chambers 14 and 15 are separated from each other in the longitudinal direction by a partition plate 17 made of a metal such as aluminum. The developer storage chambers 14 and 15 are communicated with each other on both ends thereof in the longitudinal direction.

Further, the developer storage chambers 14 and 15 are respectively provided with screw feeders 18 and 19. The screw feeders 18 and 19 are rotatably mounted in the developer storage chambers 14 and 15 in such a manner as to convey a developer while agitating the developer by rotation thereof. The screw feeders 18 and 19 are mounted in such a manner that the conveying directions thereof are made opposite to each other. Accordingly, the developer is conveyed between the developer storage chamber 14 and the developer storage chamber 15, while being agitated. By the agitation, the toner containing a magnetic material is charged. In this embodiment, the charging polarity of toner is positive. Although most of the toner is charged with positive electric charge, if image formation at a low printing rate is continued, part of the toner may be repeatedly charged. This causes toner deterioration, and may cause excessive charging or negative charging. The deteriorated toner undergoes a so-called refreshing operation, and then is discharged onto the drum surface 16 of the photosensitive drum 10 from the developing device 44.

The developing roller 22 is disposed to face the drum surface 16, with a gap of from 0.2 mm to 0.4 mm between the outer surface of the developing roller 22 and the drum surface 16 of the photosensitive drum 10. A so-called magnetic pole is disposed in the developing roller 22. The toner in the developer storage chamber 14 is magnetically attracted to the outer surface of the developing roller 22 by the magnetic force of the magnetic pole.

The toner on the outer surface of the developing roller 22 is carried toward the drum surface 16 of the photosensitive drum 10, accompanied by rotation of the developing roller 22, and is adhered to an electrostatic latent image formed on the drum surface 16 of the photosensitive drum 10 by an electric potential difference between a developing bias voltage to be applied to the developing roller 22, and a drum bias voltage to be applied to the drum surface 16 of the photosensitive drum 10. By the above operation, a toner image is formed on the drum surface 16. In this embodiment, the developing bias voltage is a bias voltage of positive polarity. It is preferable to set an electric potential difference between the developing roller 22 and the drum surface 16 to 100V or higher in order to form a satisfactory toner image. The developing roller 22 is connected to a developing bias voltage applier (not shown), and a developing bias voltage is applied to the developing roller 22 by the developing bias voltage applier.

The transfer roller 46 is a member configured to transfer, onto a sheet P, a toner image formed on the drum surface 16 of the photosensitive drum 10. The transfer roller 46 is a roller member configured such that a sponge rubber layer made of carbon, an ion-conductive filler or the like and having an electric resistance of from 1×106 to 1×1010 [Ω] is formed around a core metal member made of SUS, Fe or the like.

Referring to FIG. 2, the transfer roller 46 extends in parallel to the photosensitive drum 10, and is disposed to contact with the drum surface 16 along the conveying path 6 (see FIG. 1) in such a manner as to form a nip portion N by cooperation with the drum surface 16. A sheet P conveyed along the conveying path 6 in the conveying direction D of the sheet P is passed through the nip portion N. The transfer roller 46 is an example of a transfer member, and the nip portion N is formed between the drum surface 16 and the transfer roller 46 for nipping the sheet P therebetween.

The transfer roller 46 is connected to a transfer bias voltage supplier 52. The transfer bias voltage supplier 52 is configured to supply, to the transfer roller 46, a transfer bias voltage of a polarity opposite to the polarity of toner (polarity of electric charge on toner) for use in forming a toner image for transferring a toner image carried on the drum surface 16 onto the sheet P in the nip portion N. In this embodiment, since toner charged with positive electric charge is used, the polarity of transfer bias voltage is negative. In passing the sheet P through the nip portion N, the toner charged with positive electric charge is attracted to the transfer roller 46, and the toner image is transferred onto the sheet P.

The separating member 48 is an example of a discharging electrode member, and extends in the direction of axis of rotation of the photosensitive drum 10. The separating member 48 is disposed to face the drum surface 16 on the downstream side of the nip portion N in the conveying direction D of a sheet P. A discharging gap G is formed between the separating member 48 and the drum surface 16. The sheet P that has been passed through the nip portion N is passed through the discharging gap G, and is conveyed toward downstream. As will be described later, the sheet P is separated from the drum surface 16 while passing through the discharging gap G. The conveying path 6 (see FIG. 1) and plural conveying roller pairs disposed on the conveying path 6 are an example of sheet conveying unit configured to convey a sheet P in such a manner that the sheet P is passed through the nip portion N and through the discharging gap G.

The separating member 48 has plural separation needle portions 53 disposed along the direction of axis of rotation of the photosensitive drum 10, and a support portion 55 for supporting the separation needle portions 53 thereon.

The separating member 48 is connected to a separation bias voltage supplier 54. The separation bias voltage supplier is configured to supply, to the separating member 48, a separation bias voltage of a polarity (in this embodiment, a separation bias voltage of positive polarity) opposite to the polarity of transfer bias voltage for separating the sheet P carrying a transferred toner image thereon from the drum surface 16. By the above operation, discharging is generated between the separation needle portions 53 and the drum surface 16 (in other words, in the discharging gap G), and negative electric charge accumulated on the sheet P by a transfer operation by the transfer roller 46 is removed, whereby the sheet P is caused to be separated from the drum surface 16 by the stiffness inherent to the sheet P or the weight of the sheet P.

Referring back to FIG. 1, the toner remover 47 is configured to remove and collect the toner residues on the drum surface 16 after a toner image is transferred onto the sheet P.

The sheet P that has been passed through the discharging gap G is conveyed to the fixing portion 5 via the conveying path 6. The fixing portion 5 is configured to fix the toner image formed on the sheet P onto the sheet P by application of heat. The sheet P that has undergone the fixing process is conveyed to the discharge tray 12 via the conveying path 6.

Figure 3:
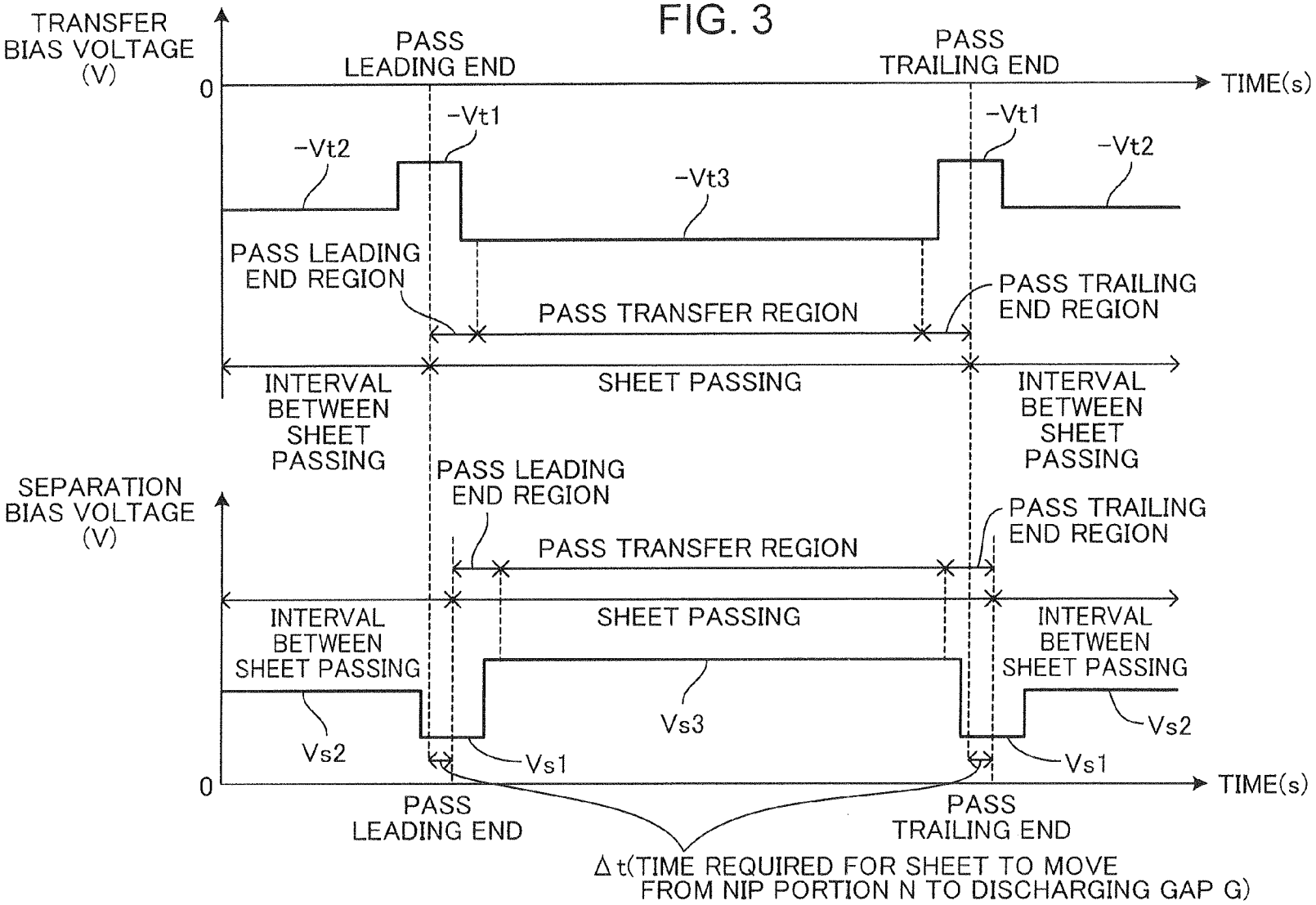
FIG. 3 is a graph showing a relationship between a transfer bias voltage to be supplied from a transfer bias supplier to a transfer roller, and a separation bias voltage to be supplied from a separation bias voltage supplier to a separating member in the image forming apparatus according to the embodiment.

In the following, there is described a relationship between a transfer bias voltage to be supplied from the transfer bias voltage supplier 52 to the transfer roller 46, and a separation bias voltage to be supplied from the separation bias voltage supplier 54 to the separating member 48 in the image forming apparatus 1 according to this embodiment. FIG. 3 is a graph showing the above relationship. The upper graph in FIG. 3 shows the transfer bias voltage. In the upper graph, the vertical axis indicates a magnitude of transfer bias voltage and the horizontal axis indicates a time. The lower graph in FIG. 3 shows the separation bias voltage. In the lower graph, the vertical axis indicates a magnitude of separation bias voltage and the horizontal axis indicates a time.

Figure 4:
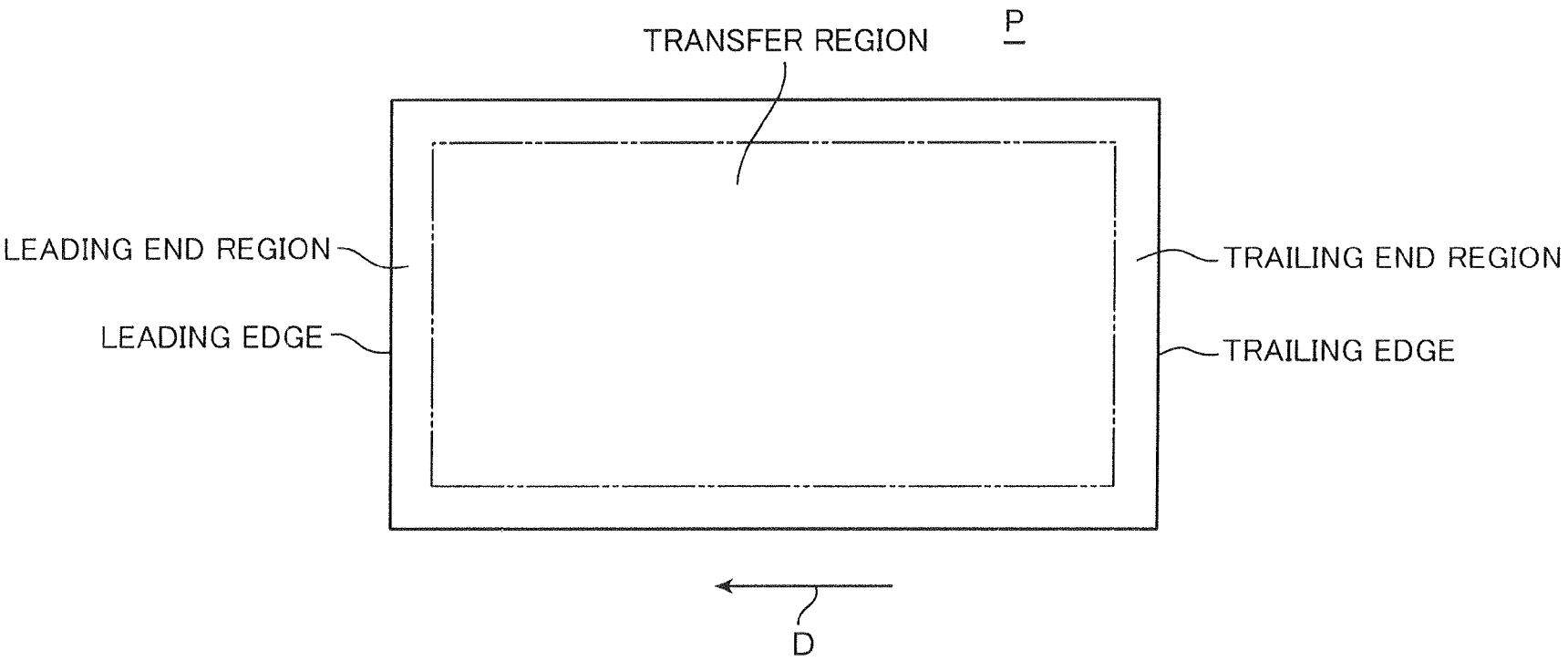
FIG. 4 is a plan view showing an example of a sheet on which a transfer image is to be transferred.

In this example, a transfer region and other regions of a sheet P are described referring to FIG. 4. FIG. 4 is a plan view of a sheet P. A transfer region is a region of a sheet P on which a toner image is to be transferred. The margin between the leading edge of the sheet P and the leading edge of the transfer region serves as a leading end region. The margin between the trailing edge of the sheet P and the trailing edge of the transfer region serves as a trailing end region.

Referring to the graph of transfer bias voltage shown in FIG. 3, the period of time when the sheet P is passed through the nip portion N is a sum of the period of time when the leading end region of the sheet P is passed through the nip portion N, the period of time when the transfer region of the sheet P is passed through the nip portion, and the period of time when the trailing end region of the sheet P is passed through the nip portion N.

Let it be assumed that −Vt1 indicates a transfer bias voltage to be applied when the leading end of the sheet P is passed through the nip portion N and when the trailing end of the sheet P is passed through the nip portion N, −Vt2 indicates a transfer bias voltage to be applied before the sheet P is passed through the nip portion N and after the sheet P is passed through the nip portion N, and −Vt3 indicates a transfer bias voltage to be applied when the transfer region of the sheet P is passed through the nip portion N.

The transfer bias voltage supplier 52 supplies a transfer bias voltage to the transfer roller 46 in such a manner that the relationship: absolute value of transfer bias voltage "−Vt1"<absolute value of transfer bias voltage "−Vt2"<absolute value of transfer bias voltage "−Vt3" is satisfied.

The transfer bias voltage "−Vt3" to be applied when the transfer region of the sheet P is passed through the nip portion N is a bias voltage of a magnitude necessary for transferring a toner image onto the sheet P.

Making the absolute value of transfer bias voltage "−Vt2" to be applied before and after the sheet P is passed through the nip portion N substantially equal to the absolute value of transfer bias voltage "−Vt3" increases the amount of negative electric charge to be supplied from the transfer roller 46 to the drum surface 16 before and after the sheet P is passed through the nip portion N, as compared with a period of time when the transfer region is passed through the nip portion N, because there is no sheet in the nip portion N before and after the sheet P is passed through the nip portion N. As a result, electric potential fluctuation may occur on the drum surface 16 before and after the sheet P is passed through the nip portion N. In view of the above, the absolute value of transfer bias voltage "−Vt2" is made smaller than the absolute value of transfer bias voltage "−Vt3" for suppressing electric potential fluctuation on the drum surface 16.

It is possible to prevent electric potential fluctuation on the drum surface 16 in the form of streaks by making the absolute value of transfer bias voltage "−Vt1" to be applied when the leading end or the trailing end of a sheet P is passed through the nip portion N smaller than the absolute value of transfer bias voltage "−Vt2" to be applied before and after the sheet P is passed through the nip portion N and smaller than the absolute value of transfer bias voltage "−Vt3" to be applied when the transfer region is passed through the nip portion N, as described above.

Specifically, as described in the background art of the present specification, when the leading end or the trailing end of a sheet P is passed through the nip portion N, an excessive electric current may flow between the drum surface 16 and the transfer roller 46 due to a sharp change in the electric resistance of the nip portion N. As a result, electric potential fluctuation in the form of streaks may occur on the drum surface 16, resulting from electric potential variation on the drum surface 16. In view of the above, the absolute value of transfer bias voltage "−Vt1" to be applied when the leading end or the trailing end of a sheet P is passed through the nip portion N is made small in the manner as described above to thereby prevent the aforementioned excessive electric current flow between the drum surface 16 and the transfer roller 46. This is advantageous in preventing electric potential fluctuation on the drum surface 16 in the form of streaks.

However, even if the transfer bias voltage is changed as described above, electric potential fluctuation may occur on the drum surface 16, as long as the separation bias voltage is kept unchanged. To describe this matter in details, the transfer bias voltage to be applied when the leading end or the trailing end of a sheet P is passed through the nip portion N is set to "−Vt1", whose absolute value is relatively small, as described above.

If the separation bias voltage to be applied when the leading end or the trailing end of a sheet P is passed through the discharging gap G is set to "Vs3" whose absolute value is relatively large, the region on the drum surface 16 in contact with the leading end or the trailing end of the sheet P when the leading end or the trailing end of the sheet P is passed through the nip portion N (hereinafter, called as a region on the drum surface 16 corresponding to the leading end or the trailing end) is charged with positive electric charge. Specifically, the transfer bias voltage "−Vt1" whose absolute value is relatively small is applied to the region on the drum surface 16 corresponding to the leading end or the trailing end when the leading end or the trailing end is passed through the nip portion N, and the separation bias voltage "Vs3" whose absolute value is relatively large is applied to the region on the drum surface 16 corresponding to the leading end or the trailing end when the leading end or the trailing end is passed through the discharging gap G. Thus, the region on the drum surface 16 corresponding to the leading end or the trailing end is charged with positive electric charge. This may generate electric potential fluctuation on the drum surface 16.

In view of the above, in this embodiment, the following separation bias voltage is supplied to the separating member 48. Referring to the graph of separation bias voltage shown in FIG. 3, the period of time when the sheet P is passed through the discharging gap G is a sum of the period of time when the leading end region of the sheet P is passed through the discharging gap G, the period of time when the transfer region of the sheet P is passed through the discharging gap G, and the period of time when the trailing end region of the sheet P is passed through the discharging gap G.

Let it be assumed that Vs1 indicates a separation bias voltage to be applied when the leading end of the sheet P is passed through the discharging gap G and when the trailing end of the sheet P is passed through the discharging gap G, Vs2 indicates a separation bias voltage to be applied before the sheet P is passed through the discharging gap G and after the sheet P is passed through the discharging gap G, and Vs3 indicates a separation bias voltage to be applied when the transfer region of the sheet P is passed through the discharging gap G. The symbol Δt indicates a period of time required for the sheet P to move from the nip portion N to the discharging gap G.

The separation bias voltage supplier 54 supplies a separation bias voltage to the separating member 48 in such a manner that the relationship: absolute value of separation bias voltage "Vs1"<absolute value of separation bias voltage "Vs2"<absolute value of separation bias voltage "Vs3" is satisfied.

By the above control, the following bias voltages are applied to the respective regions on the drum surface 16.

A separation bias voltage "Vs3", which is a bias voltage to be applied when the transfer region of the sheet P is passed through the discharging gap G, is applied to the region on the drum surface 16, to which the transfer bias voltage "−Vt3" has been applied when the transfer region of the sheet P has been passed through the nip portion N.

A separation bias voltage "Vs2", which is a bias voltage to be applied before and after the sheet P is passed through the discharging gap G, is applied to the region on the drum surface 16, to which the transfer bias voltage "−Vt2" has been applied before and after the sheet P has been passed through the nip portion N.

A separation bias voltage "Vs1", which is a bias voltage to be applied when the leading end and the trailing end of the sheet P are passed through the discharging gap G, is applied to the region on the drum surface 16, to which the transfer bias voltage "−Vt1" has been applied when the leading end and the trailing end of the sheet P have been passed through the nip portion N.

As described above, regarding the transfer bias voltage and the separation bias voltage whose polarities are opposite to each other, the image forming apparatus 1 according to the embodiment is configured such that: the separation bias voltage "Vs3" whose absolute value is relatively large is applied to the region on the drum surface 16, to which the transfer bias voltage "−Vt3" whose absolute value is relatively large is applied; and the separation bias voltage "Vs1" whose absolute value is relatively small is applied to the region on the drum surface 16, to which the transfer bias voltage "−Vt1" whose absolute value is relatively small is applied. Accordingly, it is possible to secure balance between the transfer bias voltage and the separation bias voltage to be applied to the drum surface 16 when the transfer region of a sheet P, and the leading end and the trailing end of the sheet P are passed through the nip portion N and through the discharging gap G. This makes it possible to prevent electric potential fluctuation on the drum surface 16. Thus, it is possible to make the overall electric potential on the drum surface 16 substantially uniform in charging the drum surface 16 with use of the charging roller 50.

Further, in the embodiment, the separation bias voltage "Vs2" whose absolute value is relatively medium is applied to the region on the drum surface 16, to which the transfer bias voltage "−Vt2" whose absolute value is relatively medium is applied. Accordingly, it is also possible to secure balance between the transfer bias voltage and the separation bias voltage before and after the sheet P is passed through the nip portion N and through the discharging gap G. This is more advantageous in preventing electric potential fluctuation on the drum surface 16.

As the absolute value of transfer bias voltage "−Vt1" to be supplied from the transfer bias voltage supplier 52 is increased, the absolute value of separation bias voltage "Vs1" to be supplied from the separation bias voltage supplier 54 is increased in proportion to the increase; and as the absolute value of transfer bias voltage "−Vt1" to be supplied from the transfer bias voltage supplier 52 is decreased, the absolute value of separation bias voltage "Vs1" to be supplied from the separation bias voltage supplier 54 is decreased in proportion to the decrease. The same idea is also applied to the relationship between transfer bias voltage "−Vt2" and separation bias voltage "Vs2", and to the relationship between transfer bias voltage "−Vt3" and separation bias voltage "Vs3". By the above control, it is possible to secure balance between transfer bias voltage and separation bias voltage to be applied to the drum surface 16.

The following findings (1) to (3) are obtained regarding the transfer bias voltage "−Vt1", the transfer bias voltage "−Vt2", the transfer bias voltage "−Vt3", the separation bias voltage "Vs1", the separation bias voltage "Vs2", and the separation bias voltage "Vs3".

(1) The period of time when the separation bias voltage supplier 54 supplies a first separation bias voltage (separation bias voltage "Vs1") to the separating member 48 is substantially equal to the period of time when the transfer bias voltage supplier 52 supplies a first transfer bias voltage (transfer bias voltage "−Vt1") to the transfer roller 46.

The period of time when the separation bias voltage supplier 54 supplies a second separation bias voltage (separation bias voltage "Vs2") to the separating member 48 is substantially equal to the period of time when the transfer bias voltage supplier 52 supplies a second transfer bias voltage (transfer bias voltage "−Vt2") to the transfer roller 46.

The period of time when the separation bias voltage supplier 54 supplies a third separation bias voltage (separation bias voltage "Vs3") to the separating member 48 is substantially equal to the period of time when the transfer bias voltage supplier 52 supplies a third transfer bias voltage (transfer bias voltage "−Vt3") to the transfer roller 46.

(2) The timing of starting supply of the first separation bias voltage (separation bias voltage "Vs1") to the separating member 48 by the separation bias voltage supplier 54 is later than the timing of starting supply of the first transfer bias voltage (transfer bias voltage "−Vt1") to the transfer roller 46 by the transfer bias voltage supplier 52.

The timing of starting supply of the second separation bias voltage (separation bias voltage "Vs2") to the separating member 48 by the separation bias voltage supplier 54 is later than the timing of starting supply of the second transfer bias voltage (transfer bias voltage "−Vt2") to the transfer roller 46 by the transfer bias voltage supplier 52.

The timing of starting supply of the third separation bias voltage (separation bias voltage "Vs3") to the separating member 48 by the separation bias voltage supplier 54 is later than the timing of starting supply of the third transfer bias voltage (transfer bias voltage "−Vt3") to the transfer roller 46 by the transfer bias voltage supplier 52.

(3) The value of first transfer bias voltage (transfer bias voltage "−Vt1"), the value of second transfer bias voltage (transfer bias voltage "−Vt2"), and the value of third transfer bias voltage (transfer bias voltage "−Vt3") to be supplied to the transfer roller 46 by the transfer bias voltage supplier 52 are respectively set to constant values.

The value of first separation bias voltage (separation bias voltage "Vs1"), the value of second separation bias voltage (separation bias voltage "Vs2"), and the value of third separation bias voltage (separation bias voltage "Vs3") to be supplied to the separating member 48 by the separation bias voltage supplier 54 are respectively set to constant values.

Further, in the embodiment, a single-layer organic photosensitive drum is employed as the photosensitive drum 10. In the case of using the single-layer organic photosensitive drum, the responsiveness in transferring electric charge is poor, because the photosensitive layer (drum surface 16) is configured such that the electric charge generation layer and the electric charge carrier layer are not separated from each other. This makes it difficult to eliminate electric potential fluctuation on the drum surface 16. Accordingly, the embodiment is particularly effective in using a single-layer organic photosensitive drum.

In this embodiment, the transfer bias voltage to be applied when the leading end and the trailing end of a sheet P are passed through the nip portion N is set to "−Vt1". Alternatively, the transfer bias voltage to be applied when either one of the leading end and the trailing end of a sheet P is passed through the nip portion N may be set to "−Vt1". In the above modification, in the case where the transfer bias voltage to be applied when the leading end of a sheet P is passed through the nip portion N is set to "−Vt1", the separation bias voltage to be applied when the trailing end of the sheet P is passed through the discharging gap G is set to "Vs1"; and in the case where the transfer bias voltage to be applied when the trailing end of a sheet P is passed through the nip portion N is set to "−Vt1", the separation bias voltage to be applied when the trailing end of the sheet P is passed through the discharging gap G is set to "Vs1".

In this embodiment, the drum surface 16 is charged with use of the charging roller 50 configured to be contacted with the drum surface 16. Specifically, in this embodiment, a contact charging system is employed as the system for charging the drum surface 16. The ability of charging the drum surface 16 by the contact charging system is weak, as compared with a corona charging system. Therefore, if electric potential fluctuation occurs on the drum surface 16, it is difficult to eliminate the electric potential fluctuation. Accordingly, the embodiment is particularly effective in using the image forming apparatus 1 employing a contact charging system.

In this embodiment, the sheet conveying unit includes the conveying path 6 (see FIG. 1) along which a sheet P is conveyed, and the sheet P is fed to the nip portion N and to the discharging gap G with use of the conveying path 6. The embodiment may be modified in such a manner that the sheet conveying unit includes a sheet conveyor belt on which a sheet P is placed, and the sheet P is fed to the nip portion N and to the discharging gap G by driving the sheet conveyor belt.

Figure 5:
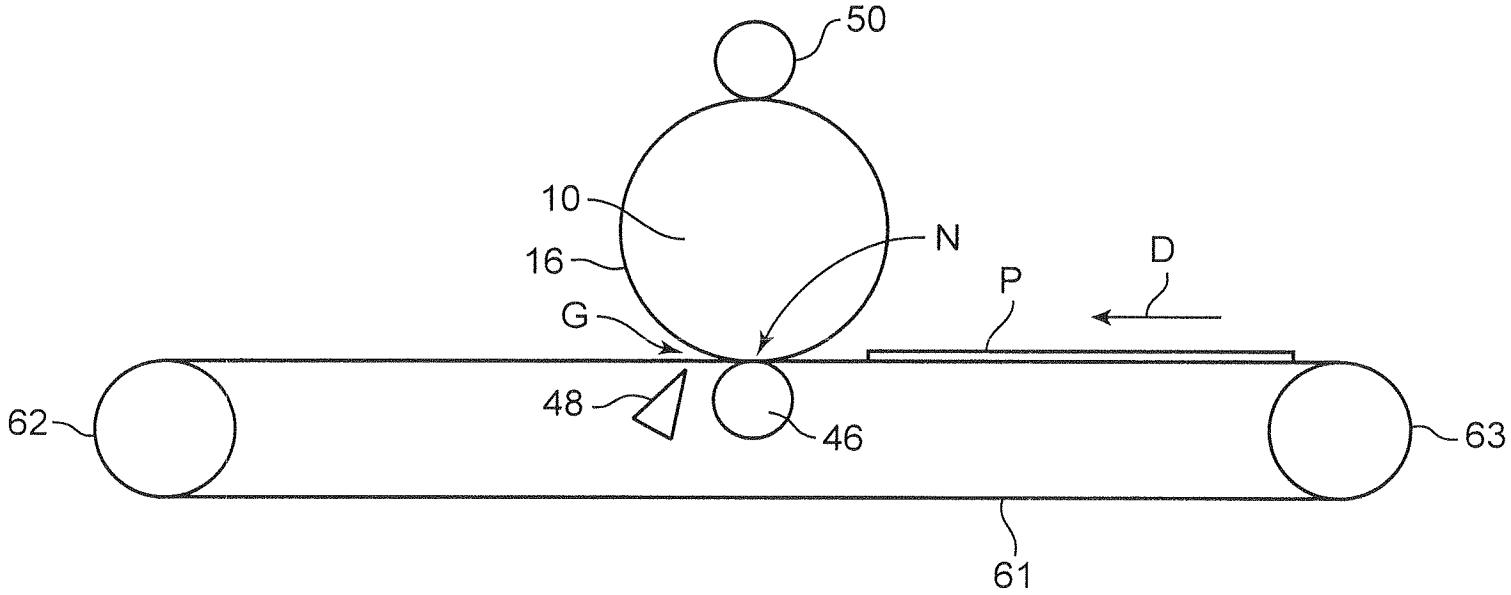
FIG. 5 is a diagram showing a positional relationship between a photosensitive drum, a charging roller, a transfer roller, a separating member, and a sheet conveying belt.

In other words, the present disclosure is also applicable to an image forming apparatus configured such that a sheet P is conveyed to the nip portion N by the sheet conveyor belt. FIG. 5 is a diagram showing a positional relationship between a photosensitive drum 10, a charging roller 50, a transfer roller 46, a separating member 48, and a sheet conveyor belt 61.

The sheet conveyor belt 61 is wound around a driving pulley 62 and a driven pulley 63 for conveying a sheet P in a conveying direction D. The sheet conveyor belt 61 is disposed in the nip portion N between a drum surface 16 and the transfer roller 46. The separating member 48 is disposed downstream of the nip portion N. The separating member 48 is disposed to face the drum surface 16 via the sheet conveyor belt 61. A discharging gap G is formed by the separating member 48 and the drum surface 16.

The sheet P placed on the sheet conveyor belt 61 undergoes a transfer process of transferring a toner image formed on the drum surface 16 onto the sheet P in the nip portion N. Then, the sheet P attracted to the drum surface 16 in the nip portion N is separated from the drum surface 16, while passing through the discharging gap G, and then, is conveyed toward downstream by the sheet conveyor belt 61.

The aforementioned effect of the embodiment is also obtained, in the case where the present disclosure is applied to an image forming apparatus configured such that a sheet P is conveyed to the nip portion N and to the discharging gap G by the sheet conveyor belt 61.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an image carrier;

a charging portion which charges the image carrier;

an exposing portion which forms an electrostatic latent image on the image carrier charged by the charging portion;

a developing portion which supplies toner to the electrostatic latent image for forming a toner image on the image carrier;

a transfer member which forms a nip portion by cooperation with the image carrier, the nip portion being configured to nip a sheet on which the toner image is to be transferred;

a discharging electrode member disposed to face the image carrier on a downstream side of the nip portion in a conveying direction of the sheet;

a sheet conveying unit which conveys the sheet in such a manner that the sheet is passed through the nip portion and through a discharging gap, the discharging gap being formed by the discharging electrode member and the image carrier;

a transfer bias voltage supplier which supplies, to the transfer member, a transfer bias voltage of a polarity opposite to a polarity of the toner for use in forming the toner image for transferring the toner image carried on the image carrier onto the sheet in the nip portion; and a separation bias voltage supplier which supplies, to the discharging electrode member, a separation bias voltage of a polarity opposite to the polarity of the transfer bias voltage for separating the sheet carrying the transferred toner image thereon from the image carrier, wherein the transfer bias voltage supplier is so configured that an absolute value of the transfer bias voltage to be supplied to the transfer member when a leading end and a trailing end of the sheet are passed through the nip portion is set smaller than an absolute value of the transfer bias voltage to be supplied to the transfer member when a transfer region of the toner image on the sheet is passed through the nip portion, the separation bias voltage supplier is so configured that an absolute value of the separation bias voltage to be supplied to the discharging electrode member when the leading end and the trailing end of the sheet are passed through the discharging gap is set smaller than an absolute value of the separation bias voltage to be supplied to the discharging electrode member when the transfer region is passed through the discharging gap, a first transfer bias voltage is the transfer bias voltage when the leading end and the trailing end are passed through the nip portion and a first separation bias voltage is the separation bias voltage when the leading end and the trailing end are passed through the discharge gap, and an absolute value of the first separation bias voltage to be supplied from the separation bias voltage supplier is increased as an absolute value of the first transfer bias voltage to be supplied from the transfer bias voltage supplier is increased, and the absolute value of the first separation bias voltage to be supplied from the separation bias voltage supplier is decreased as the absolute value of the first transfer bias voltage to be supplied from the transfer bias voltage supplier is decreased.

2. The image forming apparatus according to claim 1, wherein a photosensitive layer of the image carrier is constituted of a single-layer organic photosensitive member, the organic photosensitive member being configured such that an electric charge generation layer and an electric charge carrier layer are not separated from each other.

3. The image forming apparatus according to claim 1, wherein the charging portion includes a charging roller configured to be contacted with the image carrier for charging the image carrier with use of the charging roller.

4. The image forming apparatus according to claim 1, wherein the sheet conveying unit includes a sheet conveying path along which the sheet is conveyed for feeding the sheet to the nip portion and to the discharging gap with use of the conveying path.

5. The image forming apparatus according to claim 1, wherein the sheet conveying unit includes a sheet conveyor belt on which the sheet is placed for feeding the sheet to the nip portion and to the discharging gap by driving the sheet conveyor belt.

6. An image forming apparatus, comprising:

an image carrier;

a charging portion which charges the image carrier;

an exposing portion which forms an electrostatic latent image on the image carrier charged by the charging portion;

a developing portion which supplies toner to the electrostatic latent image for forming a toner image on the image carrier;

a transfer member which forms a nip portion by cooperation with the image carrier, the nip portion being configured to nip a sheet on which the toner image is to be transferred;

a discharging electrode member disposed to face the image carrier on a downstream side of the nip portion in a conveying direction of the sheet;

a sheet conveying unit which conveys the sheet in such a manner that the sheet is passed through the nip portion and through a discharging gap, the discharging gap being formed by the discharging electrode member and the image carrier;

a transfer bias voltage supplier which supplies, to the transfer member, a transfer bias voltage of a polarity opposite to a polarity of the toner for use in forming the toner image for transferring the toner image carried on the image carrier onto the sheet in the nip portion; and a separation bias voltage supplier which supplies, to the discharging electrode member, a separation bias voltage of a polarity opposite to the polarity of the transfer bias voltage for separating the sheet carrying the transferred toner image thereon from the image carrier, wherein the transfer bias voltage supplier is so configured that an absolute value of the transfer bias voltage to be supplied to the transfer member when at least one of a leading end and a trailing end of the sheet is passed through the nip portion is set smaller than an absolute value of the transfer bias voltage to be supplied to the transfer member when a transfer region of the toner image on the sheet is passed through the nip portion, the separation bias voltage supplier is so configured that an absolute value of the separation bias voltage to be supplied to the discharging electrode member when at least one of the leading end and the trailing end of the sheet is passed through the discharging gap is set smaller than an absolute value of the separation bias voltage to be supplied to the discharging electrode member when the transfer region is passed through the discharging gap, the at least one of the leading end and the trailing end of the sheet being such that the absolute value of the transfer bias voltage to be supplied thereto is set smaller when the at least one of the leading end and the trailing end is passed through the nip portion, the transfer bias voltage supplier is configured to supply, to the transfer member, the transfer bias voltage in such a manner that the relationship: $A<B<C$ is satisfied, and the separation bias voltage supplier is configured to supply, to the discharging electrode member, the separation bias voltage in such a manner that the relationship: $D<E<F$ is satisfied, where A: an absolute value of a first transfer bias voltage, the first transfer bias voltage being the transfer bias voltage to be applied when the leading end of the sheet is passed through the nip portion and when the trailing end of the sheet is passed through the nip portion;

B: an absolute value of a second transfer bias voltage, the second transfer bias voltage being the transfer bias voltage to be applied before the sheet is passed through the nip portion and after the sheet is passed through the nip portion;

C: an absolute value of a third transfer bias voltage, the third transfer bias voltage being the transfer bias voltage to be applied when the transfer region of the sheet is passed through the nip portion;

D: an absolute value of a first separation bias voltage, the first separation bias voltage being the separation bias voltage to be applied when the leading end of the sheet is passed through the discharging gap and when the trailing end of the sheet is passed through the discharging gap;

E: an absolute value of a second separation bias voltage, the second separation bias voltage being the separation bias voltage to be applied before the sheet is passed through the discharging gap and after the sheet is passed through the discharging gap; and F: an absolute value of a third separation bias voltage, the third separation bias voltage being the separation bias voltage to be applied when the transfer region of the sheet is passed through the discharging gap.

7. The image forming apparatus according to claim 6, wherein a period of time when the separation bias voltage supplier supplies the first separation bias voltage to the discharging electrode member is substantially equal to a period of time when the transfer bias voltage supplier supplies the first transfer bias voltage to the transfer member, a period of time when the separation bias voltage supplier supplies the second separation bias voltage to the discharging electrode member is substantially equal to a period of time when the transfer bias voltage supplier supplies the second transfer bias voltage to the transfer member, and a period of time when the separation bias voltage supplier supplies the third separation bias voltage to the discharging electrode member is substantially equal to a period of time when the transfer bias voltage supplier supplies the third transfer bias voltage to the transfer member.

8. The image forming apparatus according to claim 6, wherein a timing of starting supply of the first separation bias voltage to the discharging electrode member by the separation bias voltage supplier is later than a timing of starting supply of the first transfer bias voltage to the transfer member by the transfer bias voltage supplier, a timing of starting supply of the second separation bias voltage to the discharging electrode member by the separation bias voltage supplier is later than a timing of starting supply of the second transfer bias voltage to the transfer member by the transfer bias voltage supplier, and a timing of starting supply of the third separation bias voltage to the discharging electrode member by the separation bias voltage supplier is later than a timing of starting supply of the third transfer bias voltage to the transfer member by the transfer bias voltage supplier.

9. The image forming apparatus according to claim 6, wherein a value of the first transfer bias voltage, a value of the second transfer bias voltage, and a value of the third transfer bias voltage to be supplied to the transfer member by the transfer bias voltage supplier are respectively set to constant values, and a value of the first separation bias voltage, a value of the second separation bias voltage, and a value of the third separation bias voltage to be supplied to the discharging electrode member by the separation bias voltage supplier are respectively set to constant values.

* * * * *